United States Patent [19]

Jagst

[11] Patent Number: 4,545,093

[45] Date of Patent: Oct. 8, 1985

[54] SLIVER COILER

[75] Inventor: Peter Jagst, Monchen-Gladbach, Fed. Rep. of Germany

[73] Assignee: Trützschler GmbH & Co. Kg, Monchen-Gladbach, Fed. Rep. of Germany

[21] Appl. No.: 614,132

[22] Filed: May 25, 1984

[30] Foreign Application Priority Data

May 25, 1983 [DE] Fed. Rep. of Germany ..... 3318944

[51] Int. Cl.[4] ..... B65H 54/80

[52] U.S. Cl. ..... 19/159 R

[58] Field of Search ..... 19/159 R

[56] References Cited

U.S. PATENT DOCUMENTS

| | | | |
|---|---|---|---|
| 3,443,282 | 5/1969 | Dixon | 19/159 R |
| 3,470,587 | 10/1969 | Kincaid | 19/159 R |
| 3,503,197 | 3/1970 | Fess et al. | 19/159 R |
| 3,728,760 | 4/1973 | Johns | 19/159 R |
| 3,736,625 | 6/1973 | Johns | 19/159 R |
| 3,938,222 | 2/1976 | Garrison | 19/159 R |
| 4,003,104 | 1/1977 | Gunter | 19/159 R |
| 4,074,394 | 2/1978 | Kunig et al. | 19/159 R |

FOREIGN PATENT DOCUMENTS

| | | | |
|---|---|---|---|
| 1047081 | 12/1958 | Fed. Rep. of Germany | 19/159 R |
| 1843153 | 12/1961 | Fed. Rep. of Germany . | |
| 1216744 | 11/1966 | Fed. Rep. of Germany . | |
| 7338609 | 10/1973 | Fed. Rep. of Germany . | |
| 3003868 | 5/1981 | Fed. Rep. of Germany | 19/159 R |

*Primary Examiner*—Louis K. Rimrodt

*Attorney, Agent, or Firm*—Spencer & Frank

[57] ABSTRACT

A sliver coiler including a rotary head supported in a machine frame. A device is provided for rotating the rotary head about its rotary axis. A pair of parallel extending cooperating feed rollers are rotatably supported in the rotary head for drawing sliver into the rotary head and discharging the sliver therefrom to deposit the sliver underneath the rotary head. A sliver coiler component surrounds the rotary head and has a circular track. During rotation, the rotary head turns relative to the sliver coiler component. A driving device provided for rotating the feed rollers includes a runner element which is rotatably supported by the rotary head and in contact with the circular track for running thereon during rotation of the rotary head, and a torque-transmitting mechanism for applying a driving torque from the runner element to the feed rollers.

12 Claims, 5 Drawing Figures

SLIVER COILER

BACKGROUND OF THE INVENTION

This invention relates to a sliver coiler for a carding machine, drafting frame or the like and which has a rotary head which is mounted in the machine frame and by means of which, during normal operation of the machine, sliver is deposited in a coiler can positioned underneath the rotary head. The rotary head as well as feed rollers situated within the rotary head are driven components.

In a known sliver coiler in the inner space of a driven rotary head driven feed rollers (calender rollers) are positioned. The rotary motion of the feed rollers is derived from a stationarily mounted ring gear which has internal teeth which mesh with an intermediate drive having a trailing miter wheel gearing. The latter is driven by a pinion which, in turn, is rotated by the intermediate drive. Such an arrangement is complex and requires expensive manufacturing processes.

SUMMARY OF THE INVENTION

It is an object of the invention to provide an improved sliver coiler of the above-outlined type from which the discussed disadvantages are eliminated and which, in particular, is structurally simple and inexpensive.

This object and others to become apparent as the specification progresses, are accomplished by the invention, according to which, briefly stated, for driving the feed rollers a rotary drive element, such as a runner wheel, is provided which rolls on a surface of a sliver coiler component arranged externally of and surrounding the rotary head.

By virtue of the invention, the ring gear with inner teeth, the intermediate drive and the miter wheel gearing are eliminated without the need of any substitute mechanism, resulting in a very substantial structural simplification and in a significant reduction in cost. Thus, the rotary head, instead of being a complex mechanism, has the configuration of a simple plate-like structure, made, for example, of sheet metal. Noise reduction in the sliver coiling operation is a further advantage of the invention. Also, higher rpm's may be achieved and further, the rpm of the rotary disc gradually increases or decreases so that, as it was found in practice, no slippage between the runner wheel and the travel surface occurs.

Preferably, the drive element is a runner wheel whose peripheral running surface is formed of an elastomer ring made, for example, of hard rubber to enhance noise reduction. According to a preferred embodiment, the drive element runs on, and is thus in a frictional contact with an inner surface of a stationarily arranged rotary-head plate. This embodiment finds application in systems where the coiler can is rotated. According to a second preferred embodiment of the invention, the drive element runs on the inner surface of a rotatable outer rotary head. This embodiment finds application in arrangements where the coiler can is maintained stationary.

According to a further feature of the invention, the drive element, such as a runner wheel and a feed roller (calender roller) are rotatable together about a fixed (non-rotatable) shaft. The runner wheel is arranged as an axial prolongation of the feed roller. In order to drive the other feed roller of the feed roller pair, expediently a torque-transmitting component such as a spur gear is rotatably mounted on the shaft. The spur gear meshes with an additional torque-transmitting element such as another spur gear which drives the other feed roller.

According to a further feature of the invention, the shaft is oriented horizontally. The additional torque-transmitting element and the other feed roller are arranged horizontally and parallel to the shaft; this permits space saving and a construction of small height. According to a further feature of the invention, the shaft is spring-biased to ensure a secure frictional contact of the runner wheel with the travel surface. According to still another feature of the invention, the runner wheel, the feed rollers and the torque-transmitting elements are arranged axially displaceably on the shaft whereby a speed variation of the runner wheel, the feed rollers and the torque-transmitting elements may be effected. The diameter of the running circle of the runner wheel may be changed by an axial shifting whereby a correction of the sliver feed is obtained.

The invention further provides for an easy accessibility of the feed rollers. Upon opening of the sliver trumpet cover one of the feed rollers will be situated externally of the sliver guide assembly if that feed roller is mounted on the pivotal sliver trumpet cover.

DESCRIPTION OF THE PREFERRED EMBODIMENTS

Figure 1:
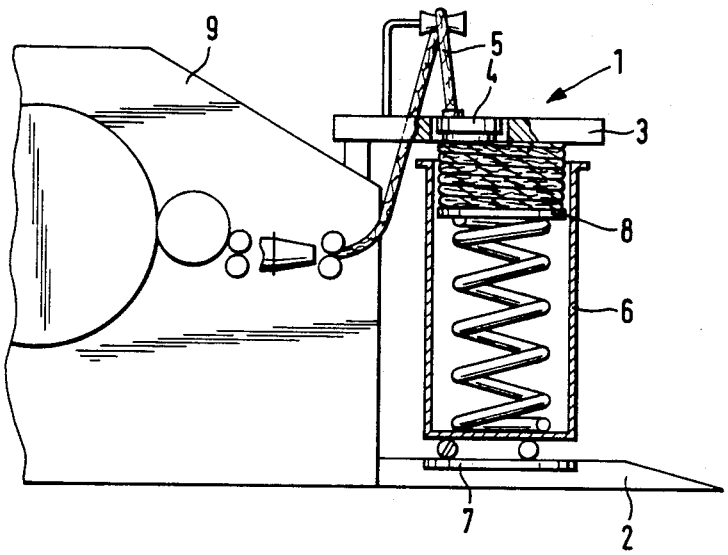
FIG. 1 is a side elevational view of a sliver coiler incorporating the invention.

Turning to FIG. 1, there is shown a sliver coiler generally designated at 1 which is arranged at the output side of a carding machine 9. The machine frame for the sliver coiler 1 includes a horizontal, elongated base plate 2 and a horizontal rotary-head plate 3 which is situated vertically spaced above the base plate 2. Also, referring to FIGS. 2 and 3, the rotary-head plate 3 supports a rotary head 4 which includes a trumpet 10, feed rollers (calender rollers) 11*a* and 11*b* and a pressing plate 12. The underside of the pressing plate 12 is substantially coplanar with the underside of the lower cover plate 3*b* of the head plate 3.

During normal operation of the sliver coiler 1, the feed rollers 11*a* and 11*b* are driven such that the sliver 5, which is guided to the rotary head 4 through the trumpet 10, is deposited in a coiler can 6 which is supported on the base plate 2 underneath the rotary head 4 and the rotary-head plate 3.

The base plate 2 comprises a rotatable bottom plate 7 to impart a rotary motion to the coiler can 6 supported on the bottom plate 7 as the sliver 5 is deposited in the coiler can 6 by the rotary head 4. The coiler can 6 has a planar underside which may be provided with casters. The bottom 8 of the coiler can 6 is either rigidly affixed to the coiler can 6 or, as shown in FIG. 1, is vertically displaceably mounted therein. In the latter case the sliver 5 introduced into the coiler can 6 projects beyond the top edge of the coiler can 6 and is in engagement with the essentially planar underside of the rotary-head plate 3 and the pressing plate 12 during the major part of the can filling operation and after completion of such operation. In case the coiler can 6 has a stationary bottom, after filling of the coiler can 6 the sliver projects beyond the upper edge of the coiler can 6 and engages under pressure the underface of the lower cover plate 3*b* of the rotary-head plate 3 and the pressing plate 12. In either case, after filling the coiler can 6, the sliver deposited therein projects beyond the upper edges of the coiler can as seen in FIG. 1 and the sliver, by virtue of its inherent elasticity or by means of the upwardly biased vertically displaceable coiler can bottom 8 is pressed against the underface of the rotary-head plate 3 and the pressing plate 12. If no pressing force is exerted from above on the sliver 5, the latter projects to a greater extent beyond the upper edges of the coiler can 6. Such is the case, for example, during transportation of the coiler can 6 as the full can 6 is, during coiler can replacement, moved off the base plate 2 from under the rotary head 4. The pressing plate 12 (rotary plate, pressing disc or coiler ring) is provided with two extension arms 12*a*, 12*b* and is supported by two roller bearings 12*c*, 12*d* on the inner face of the lower cover plate 3*b* of the rotary-head plate 3.

Figure 2:
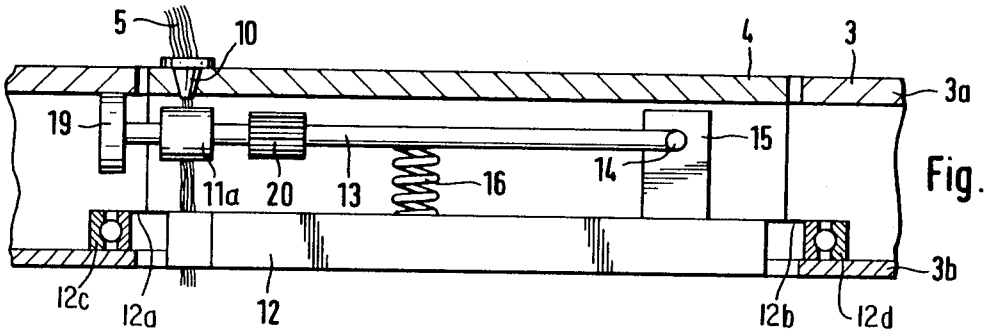
FIG. 2 is a sectional side elevational view of a preferred embodiment of the invention.
Figure 2A:
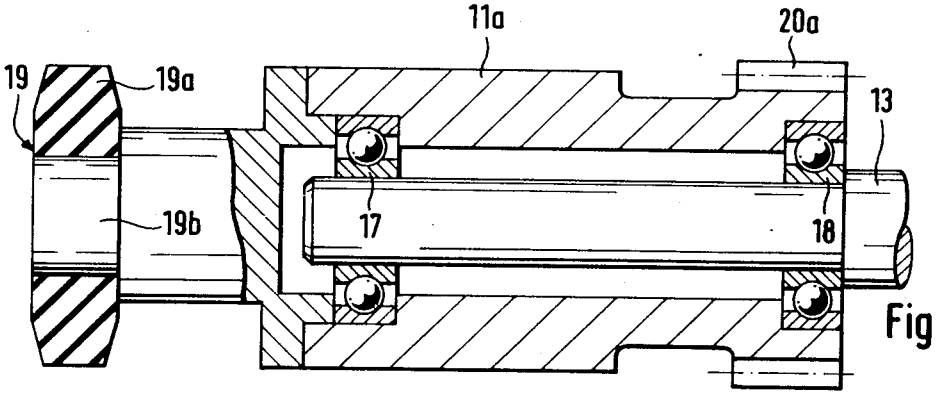
FIG. 2*a* is a sectional side elevational detail of FIG. 2 on an enlarged scale.

With further reference to FIG. 2, a shaft 13 is disposed in the rotary head 4 and has one end which is supported in a pivot bearing 14 arranged in a support block 15 mounted on the upper face of the pressing plate 12. This arrangement provides that the shaft 13 is pivotal in a vertical plane. The shaft 13 is biased in an upward direction by a compression spring 16 which, with its upper end is in engagement with the shaft 13 while its lower end is supported on the upper face of the pressing plate 12. Also referring to FIG. 2*a*, on the end of the shaft 13 remote from the pivot bearing 14 there are rotatably mounted, by means of ball bearings 17 and 18, a runner wheel 19, a feed roller 11*a* and a torque-transmitting element, such as a gear 20*a*. The runner wheel 19 which is formed of a metal cylinder 19*b* having a hard rubber rim 19*a*, runs on the stationary inner face of the upper cover plate 3*a* of the head plate 3, that is, on a surface which is spatially independent from the rotary head 4. In this manner, the feed roller 11*a* and the gear 20*a* fixedly connected with the roller 19 are also rotated about the shaft 13.

The feed roller 11*a* and the gear 20*b* are provided with a shaft 23 which is rotary disposed in a bearing 24 mounted on the upper face of the pressing plate 12.

Figure 3:
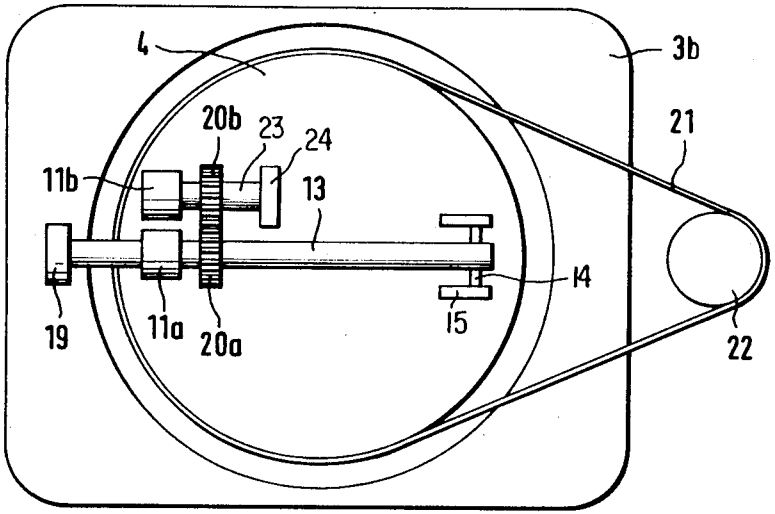
FIG. 3 is a schematic top plan view of the structure shown in FIG. 2 with the upper cover plate 3*a* and top of rotary head 4 removed.

Turning to FIG. 3, the gear 20*a* meshes with a gear 20*b* having an axis arranged parallel to the shaft 13. The gear 20*b* is affixed to the second feed roller 11*b*. In this manner, the rotation of the runner wheel 19 is directly transmitted to the feed roller 11*a* and, with the intermediary of gears 20*a* and 20*b* to the feed roller 11*b*. The rotary head 4 is driven by a belt 21 trained about the rotary head 4 and a coiler drive shaft 22.

Figure 4:
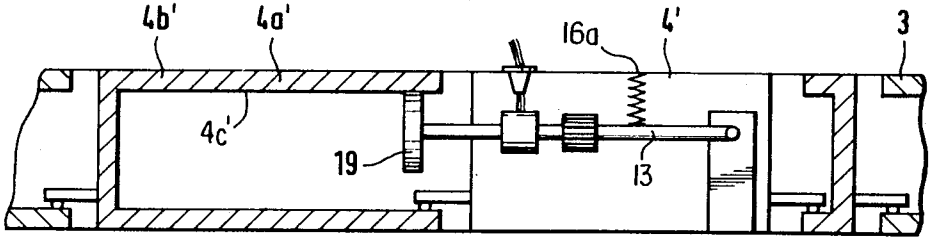
FIG. 4 is a schematic sectional side elevational view of another preferred embodiment of the invention.

Turning now to the embodiment illustrated in FIG. 4, an inner rotary head 4' is supported by ball bearings in an outer rotary head 4*a'*. The outer rotary head 4*a'*, in turn, is supported in the rotary-head plate 3 by means of ball bearings. The inner rotary head 4' turns faster than the outer rotary head 4*a'*. In this embodiment, the coiler can which is not illustrated in FIG. 4, is supported stationarily underneath the rotary-head plate 3, the outer rotary head 4*a'* and the inner rotary head 4'. The wheel 19 travels on the inner face 4*c'* of the upper cover plate 4*b'* of the outer rotary head 4*a'*. A tension spring 16*a* is connected between shaft 13 and the upper plate of rotary head 4' to bias shaft 13, and hence runner wheel 19, upwardly. Obviously, a compression spring, such as spring 16 shown in FIG. 2 may alternatively be employed for this purpose.

An arrangement with inner rotary head and an outer rotary head is known from the DE-PS 12 16 744.

It will be understood that the above description of the present invention is susceptible to various modifications, changes and adaptations, and the same are intended to be comprehended within the meaning and range of equivalents of the appended claims.

What is claimed is:

1. In a sliver coiler including a machine frame; a rotary head being supported in the machine frame and having a rotary axis; means for rotating said rotary head about said rotary axis; a pair of parallel extending cooperating feed rollers rotatably supported in said rotary head for drawing sliver into said rotary head and discharging the sliver therefrom to deposit the sliver underneath the rotary head; a sliver coiler component surrounding said rotary head and having a circular track; during rotation said rotary head turning relative to said sliver coiler component; and driving means for rotating said feed rollers; the improvement wherein said driving means comprises a runner element rotatably supported by said rotary head; said runner element being in a frictional contact with said circular track for running thereon during rotation of said rotary head; and torque-transmitting means for applying a driving torque from said runner element to said feed rollers.

2. A sliver coiler as defined in claim 1, wherein said sliver coiler component is a head plate having an inner surface, said inner surface including said circular track.

3. A sliver coiler as defined in claim 1, wherein said rotary head is an inner rotary head and said sliver coiler component is an outer rotary head; said outer rotary head having an inner surface including said circular track.

4. A sliver coiler as defined in claim 1, wherein said runner element is a runner wheel.

5. A sliver coiler as defined in claim 4, wherein said runner wheel has an elastomer rim.

6. A sliver coiler as defined in claim 1, further comprising a support shaft carried by said rotary head; said support shaft rotatably supporting said runner element and one of said feed rollers; said runner element and said one feed roller being torque-transmittingly connected to one another.

7. A sliver coiler as defined in claim 6, further comprising a pivotal support carried by said rotary head; said support shaft being held by said pivotal support and being swingable in a vertical plane about said pivotal support.

8. A sliver coiler as defined in claim 7, further comprising spring means for biasing said shaft to press said runner element against said circular track.

9. A sliver coiler as defined in claim 6, wherein the other feed roller is arranged adjacent said support shaft and further wherein said torque-transmitting means comprises a first torque-transmitting element rotatably mounted on said shaft and connected with said runner element to rotate therewith in unison and a second torque-transmitting element connected in axial alignment with said other feed roller to rotate therewith in unison; said first and second torque-transmitting elements being connected to one another for transmitting a torque from said first torque-transmitting element to said second torque-transmitting element.

10. A sliver coiler as defined in claim 9, wherein said first and second torque-transmitting elements are meshing gears.

11. A sliver coiler as defined in claim 9, wherein said other feed roller and said second torque-transmitting element have respective rotary axes extending horizontally and parallel to said shaft.

12. A sliver coiler as defined in claim 9, wherein the position of said runner element, said feed rollers and said first and second torque-transmitting elements is adjustable along said shaft.

* * * * *